US006651912B2

(12) United States Patent
Gulati et al.

(10) Patent No.: US 6,651,912 B2
(45) Date of Patent: Nov. 25, 2003

(54) REFRACTORY BURNER NOZZLE WITH STRESS RELIEF SLITS

(75) Inventors: Suresh T. Gulati, Elmira, NY (US); David I. Wilcox, Mansfield, PA (US)

(73) Assignee: Corning Incorporated, Corning, NY (US)

( * ) Notice: Subject to any disclaimer, the term of this patent is extended or adjusted under 35 U.S.C. 154(b) by 110 days.

(21) Appl. No.: 09/769,907

(22) Filed: Jan. 25, 2001

(65) Prior Publication Data

US 2001/0042798 A1 Nov. 22, 2001

Related U.S. Application Data

(60) Provisional application No. 60/180,103, filed on Feb. 3, 2000.

(51) Int. Cl.[7] ..... B05B 1/14; A62C 2/08; F23D 14/68

(52) U.S. Cl. ..... 239/553; 239/548; 239/553.5; 239/553.3; 239/552

(58) Field of Search ..... 239/553, 548, 239/553.5, 553.3, 568, 552, 556; 431/174, 180, 187, 189, 354; 126/39 R, 39 H, 39 E

(56) References Cited

U.S. PATENT DOCUMENTS

| | | | | |
|---|---|---|---|---|
| 1,478,255 A | | 12/1923 | Reid | |
| 3,720,496 A | * | 3/1973 | Briggs | 431/353 |
| 4,952,218 A | | 8/1990 | Lipp et al. | 48/86 |
| 5,351,489 A | | 10/1994 | Okamoto et al. | 60/740 |
| 5,785,880 A | | 7/1998 | Heaslip et al. | 222/594 |
| 5,842,849 A | * | 12/1998 | Huang | 431/284 |
| 5,980,240 A | * | 11/1999 | Krautzig et al. | 431/285 |
| 6,044,803 A | * | 4/2000 | Hamos et al. | 122/16 |
| 6,132,204 A | * | 10/2000 | Snyder et al. | 431/174 |
| 6,152,052 A | * | 11/2000 | Saxon et al. | 110/262 |

* cited by examiner

*Primary Examiner*—Davis Hwu
(74) *Attorney, Agent, or Firm*—Vincent T. Kung

(57) ABSTRACT

A burner nozzle having a hot face, side surfaces, and a plurality of internal gas flow passages and comprising a plurality of slits oriented in at least two different directions, wherein a selected number of the slits are formed in the hot face and/or side surfaces. The optimized location and depth of the slits relieve stresses that arise from temperature differences within the burner nozzle, caused by operation in high temperature furnaces, thereby extending the life (time to failure by fracture) of the burner nozzle.

35 Claims, 12 Drawing Sheets

FIG. 7 EFFECT OF STRESS SLITS ON STRESS REDUCTION IN THE ROOF OF THE CENTER FLOW PASSAGE
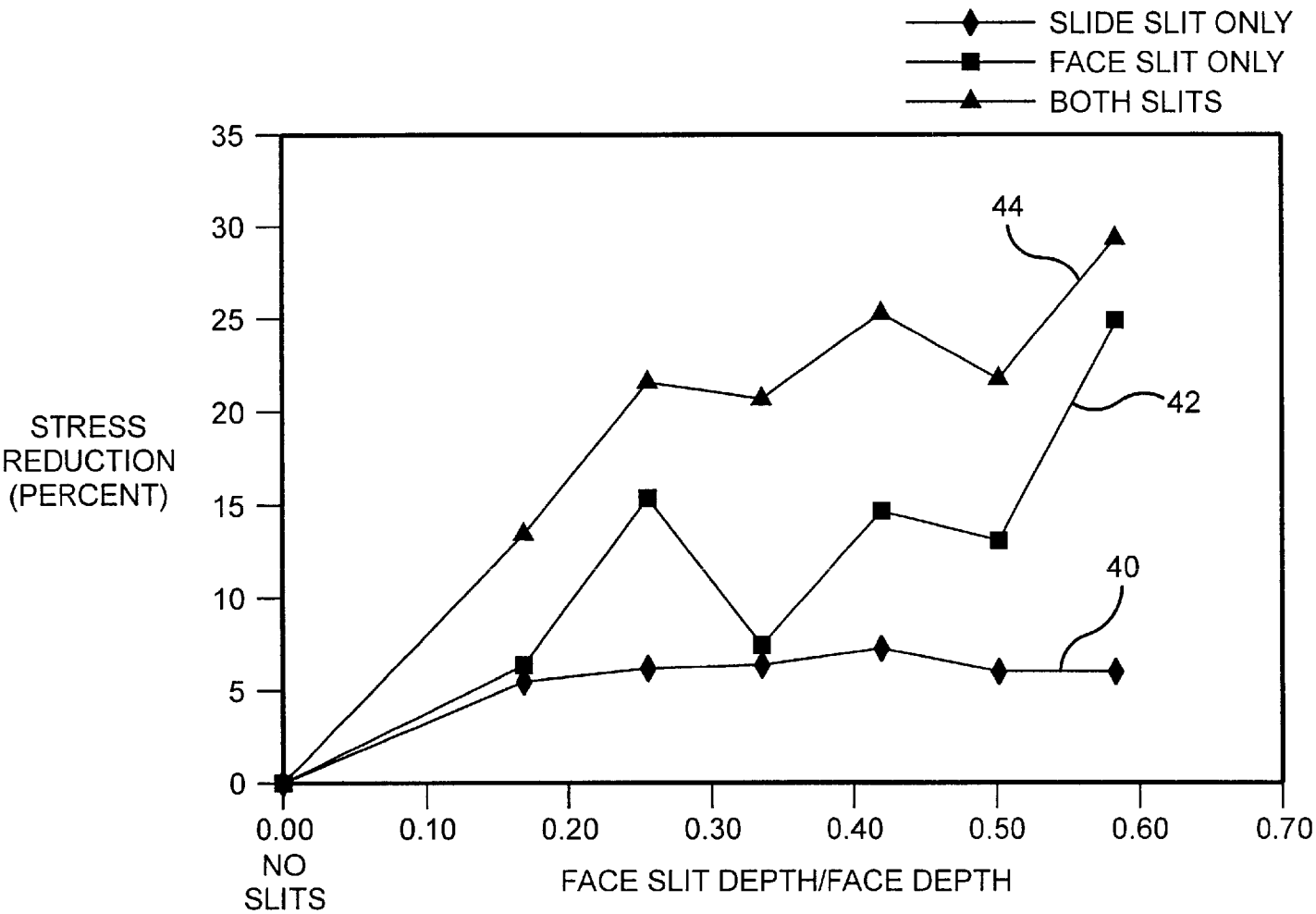

FIG. 8 EFFECT OF STRESS SLITS ON STRESS REDUCTION IN THE ROOF OF THE PLENUM
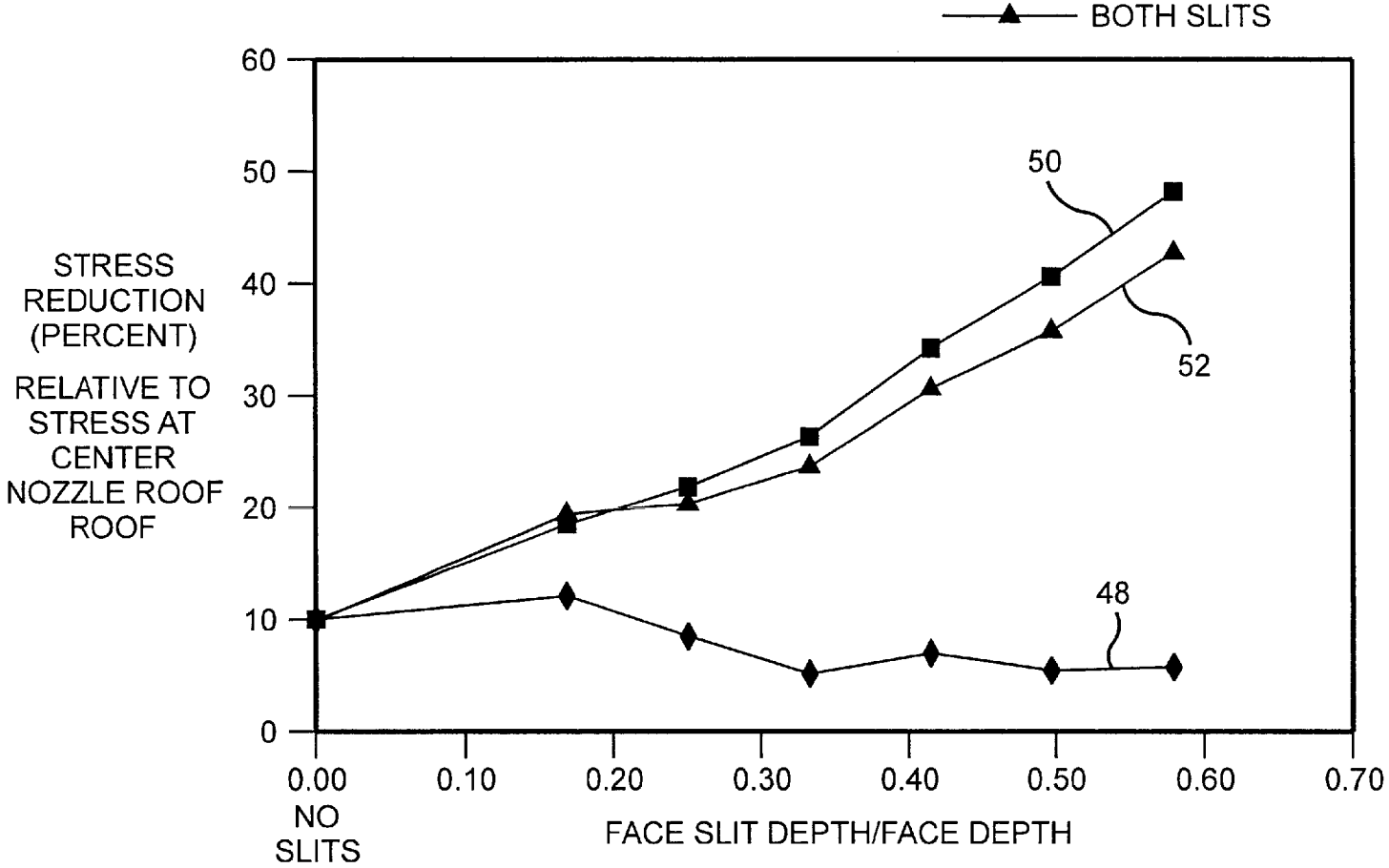

FIG. 9 EFFECT OF STRESS SLITS ON STRESS REDUCTION IN THE ROOF OF THE OUTBOARD FLOW PASSAGES
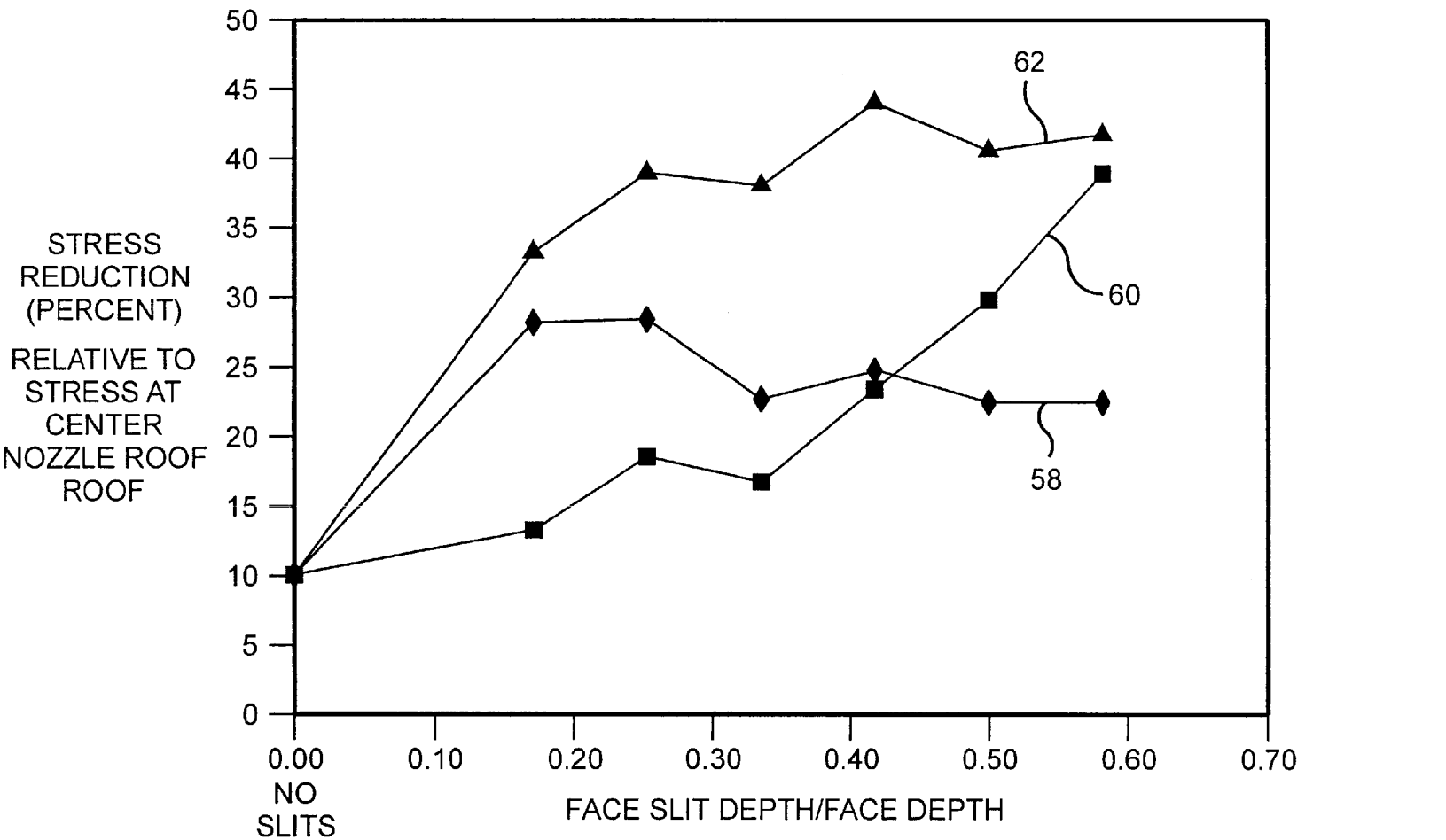

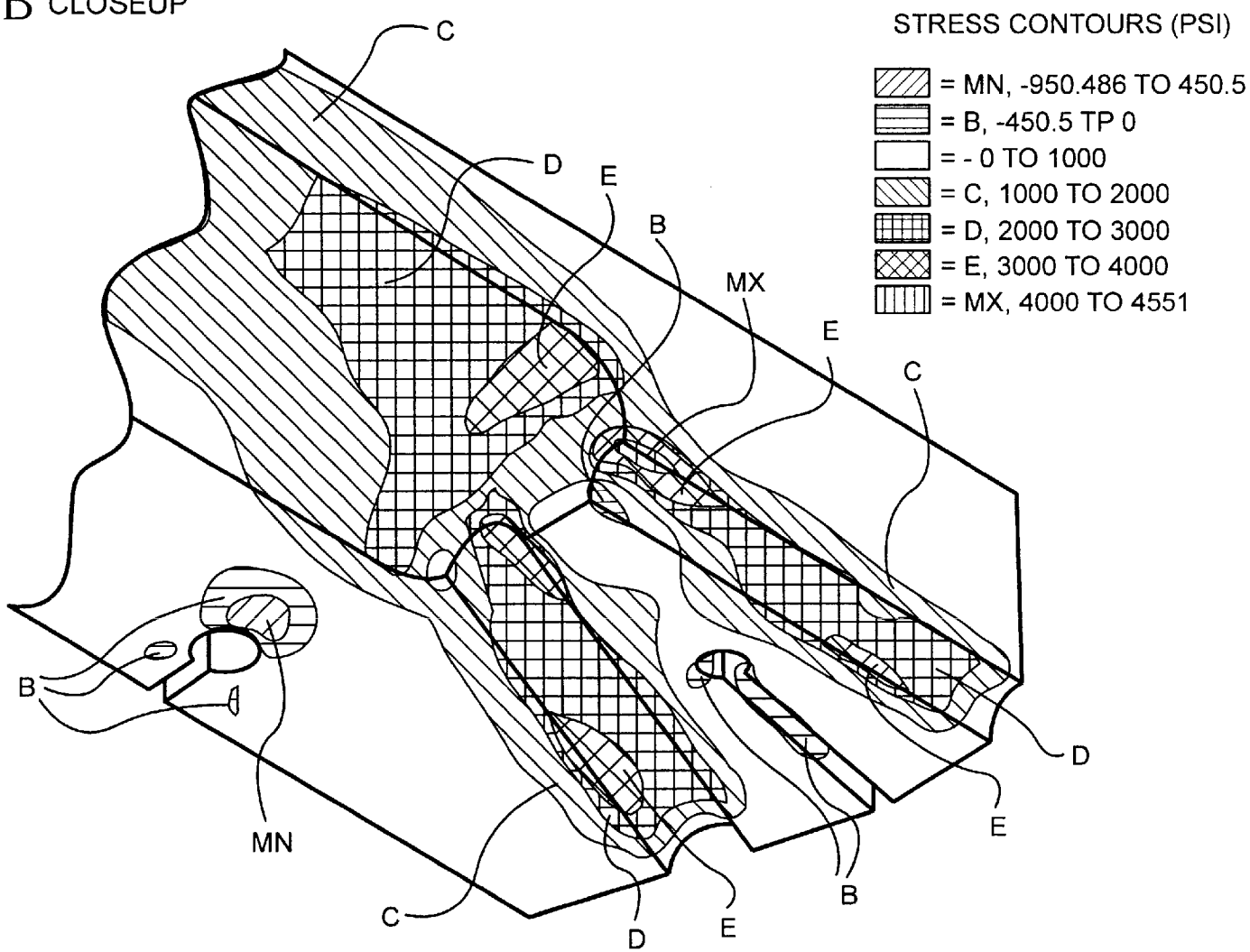
FIG. 10B CLOSEUP

REFRACTORY BURNER NOZZLE WITH STRESS RELIEF SLITS

CLAIM OF PRIORTY

This Application claims priority from Provisional Application No. 60/180,103, entitled DESIGN AND MANUFACTURE OF REFRACTORY BURNERS, which was filed on Feb. 3, 2000, in the U.S. Patent and Trademark Office.

BACKGROUND OF THE INVENTION

1. Field of the Invention

The invention relates generally to refractory burner nozzles used to fire high temperature furnaces such as those in glass melting furnaces. More specifically, the invention relates to stress-relieving mechanisms for a burner nozzle.

2. Background Art

Burner nozzles employed in high temperature furnaces, such as glass melting furnaces, are made of refractory materials that can withstand high operating temperatures, for example, of greater than 900° C. without softening. In operations, combustible gases flowing through internal passages of the burner nozzle typically have a much lower temperature than a "hot face" that is exposed to the combustion zone and operating temperature of the furnace. This situation results in relatively large temperature gradients across the burner nozzle. These large temperature gradients cause thermal stresses in the burner nozzle, which at high levels may be sufficient to fracture the burner nozzle. In general, compressive stress develops in the heated hot face portion and tensile stress develops in the cooler portion of the burner's refractory body. The ultimate tensile strength of refractory materials is usually much lower in magnitude than their ultimate compressive strength. Thus, thermal stresses in refractory materials result in fracture cracks propagating from the cooler region toward the hot face.

FIG. 1 illustrates a burner nozzle design of the prior art, as described in detail in European Patent Application EP 0969249A2 (Snyder et al.) by Praxair Technology, Inc., filed Jun. 29, 1999. The burner is of a refractory construction with a substantially rectangular three-dimensional form, with three nozzle ports arranged in a fan-shape, terminating in the hot face of the burner, to produce a wide flame. Although this Patent Application shows slits on the side surfaces of a burner nozzle, the Patent Application does not disclose using slits in the hot face, nor does it teach the optimal placement or depth of side surface slits.

FIGS. 2A–2C show the types of fractures that are typically observed in burner nozzles. The fractures can be classified according to their relative orientation with respect to the longitudinal centerline of the burner nozzle. For example, the most common type of fracture, in burner nozzles of the kind described in the Praxair patent, is a so-called transverse fracture 1 as illustrated in FIG. 2A, since it transverses the longitudinal centerline of the burner. The fracture 3 shown in FIG. 2B is a longitudinal fracture. This type of fracture runs along the centerline of the burner, between from the colder region 5, the surface of the burner that is farthest from the furnace combustion zone (not shown), and the hot face 7. Fractures probably start in a high stress region (an area with a combined high temperature change over a small dimension and area change, such as the junction between a plenum and the discharge flow nozzles.) FIG. 2C shows a diagonal fracture 9, which is less common.

Although the scientific literature[1] has touched upon the fact that thermal stresses in a refractory article can be reduced by decreasing the linear dimension of a section of the refractory article that is perpendicular to the thermal flux, the literature does not adequately discuss, not to mention effectively teach, how to optimize thermal stress reduction in the refractory article. Nor does the literature or relevant patents suggest where to locate stress relieving slits in the refractory article and how deep a slit should be. Therefore, we believe that we have discovered the optimal placement and depth for achieving the desired result of reducing or even eliminating thermal stresses and to prolong the useful lifetime of burner nozzles.

SUMMARY OF THE INVENTION

The invention relates in one aspect to the optimized placement and depth of stress relieving slits in a burner nozzle having a hot face, side surfaces, and a plurality of internal gas flow passages. The burner nozzle comprises a plurality of stress relieving slits oriented in at least two different directions, and a selected number of the slits formed in the hot face. In some embodiments, a selected number of the slits are formed in the side surfaces. In some embodiments, the burner nozzle further includes an internal plenum smoothly or fluidly connected to the internal flow passages. In some embodiments, the slits formed in the hot face have a depth of approximately 50% to 70% of the perpendicular distance from the hot face to a leading edge of the plenum. Stated in another fashion, in some embodiments, the slits formed in the hot face have a depth of approximately 10% to 75% of a length of a radius that bisects an angle formed by the longitudinal axes of two adjacent internal flow passages as they terminate in the hot face. In some embodiments, the slits formed in the side surfaces, relative to the hot face, are positioned approximately 30% to 50% of a length of the burner nozzle. The slits formed in the side surfaces have a depth of 20% to 50% of the thickness of the side surfaces.

Thermal stresses experienced by the burner nozzle are substantially reduced by at least 10%, relative to a burner that does not have a combination of: a plurality of stress-relieving slits, each having a predetermined depth, formed in the hot face, where the slits are positioned between adjacent internal flow passages, and at least one stress slit is formed in each side surface. In comparison to a burner having only stress slits formed in the side surfaces, the thermal stresses experienced by the burner nozzle are reduced by at least 15%, and to a burner having no stress slits, the thermal stresses experienced by the burner nozzle are reduced by at least 20%. In particular, the thermal stresses experienced by the burner in the roof and floor of a center internal flow passage, an outboard internal flow passage, or a plenum, and are all reduced by at least 10%, relative to a burner having only stress slits formed in the side surfaces. Moreover, by employing optimized placement of the stress-relieving slits, the useful lifetime of a burner nozzle is prolonged as a function of stress reduction by at least one order of magnitude.

Other aspects and advantages of the invention will be apparent from the following description and the appended claims.

BRIEF DESCRIPTION OF THE FIGURES

FIG. 7 is a graph illustrating the effect of stress slits on stress at the roof of the center flow passage of the burner nozzle shown in FIG. 3A.

FIG. 8 is a graph illustrating the effect of stress slits on stress at the roof of the plenum of the burner nozzle shown in FIG. 3A.

FIG. 9 is a graph illustrating the effect of stress slits on stress at the roof of the outboard flow passages of the burner nozzle shown in FIG. 3A.

FIG. 10B is a close-up view of the stress contours, shown in FIG. 10A, at the hot face and the end of the plenum of the burner nozzle shown in FIG. 3A.

DETAILED DESCRIPTION OF THE INVENTION

Embodiments of the invention provide a stress-relieving mechanism for a burner nozzle. In general, the stress-relieving mechanism comprises forming in the burner nozzle a plurality of slits oriented in at least two different directions. The slits are located on the hot face and side-surfaces of the burner nozzle. A thermal stress analysis of burner nozzles having a combination of slits formed in both the hot face and side surfaces show that we can achieve significant reduction of thermal stresses in the burner. Stress reduction also imparts a salutary effect on the lifetime of a burner nozzle, which will be discussed in greater detail below. Analytical results further show that the deeper the stress slits penetrate into the burner nozzle block, the greater the reduction in the overall stress in the burner. Yet, to ensure the structural integrity of the burner nozzle, there are practical limits to how deep the stress slits can penetrate into the burner nozzle.

The optimal depth of a slit formed in the hot face is determined according to certain standard parameters and principles employed in thermal stress and structural analysis. These parameters used in predictive analysis need to balance the competing goals of forming slits that are sufficiently deep to reduce stress effectively and significantly, while simultaneously preserving the structural integrity of the burner nozzle block. Generally, to determine thermal stress analysis of brittle materials, such as ceramics or other refractory, a comparison is made of the principal stress factors with the tolerances of the material. In the present invention, we compared the first principal stress, tension, to the ultimate tensile strength of the refractory material. We found that by incorporating stress relieving slits at optimized locations and at predetermined depths, we were able reduce the first principal stress to be within the tensile strength tolerances of the material.

Figure 3A:
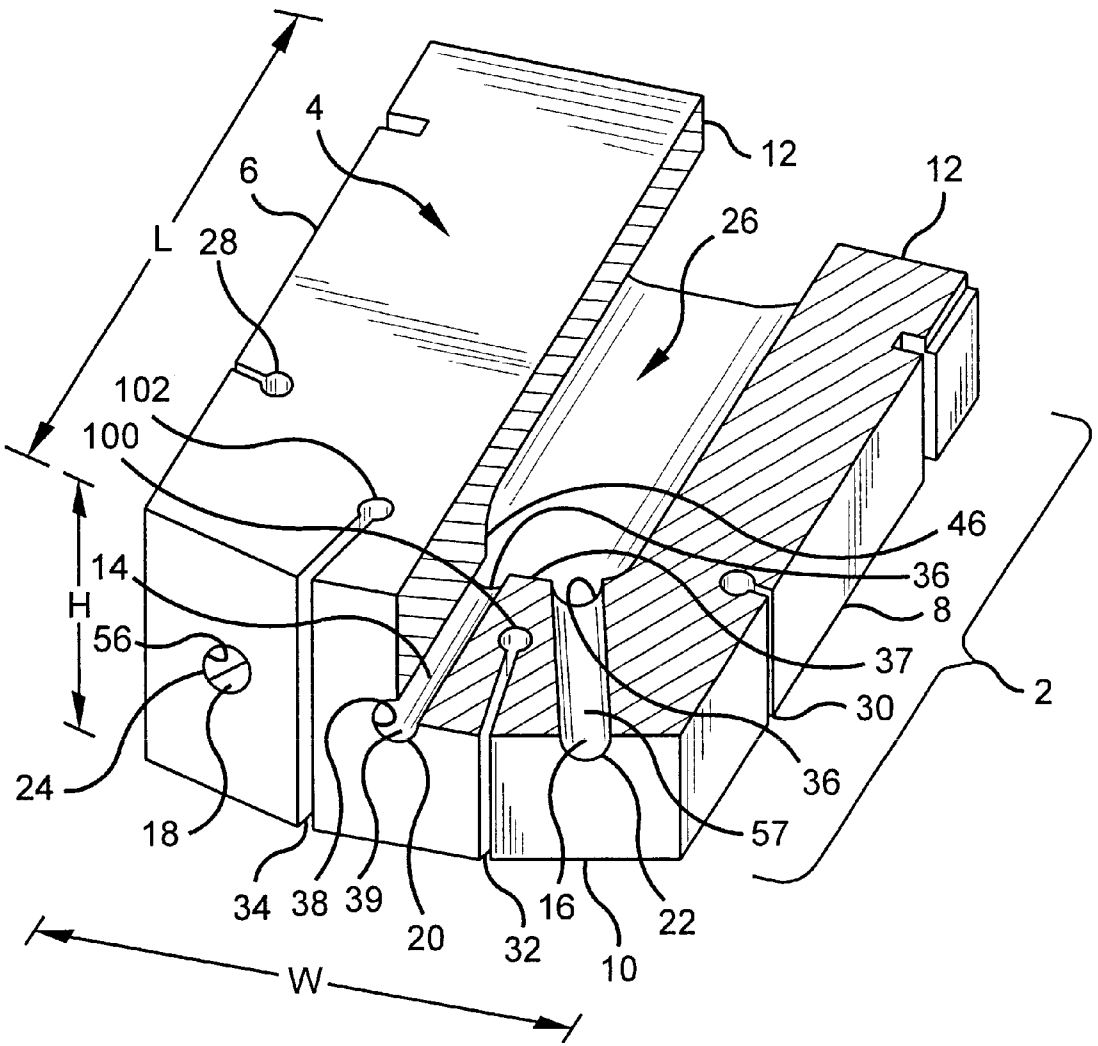
FIG. 3A shows a perspective view of a burner nozzle according to one embodiment of the invention having a full plenum, and with one quarter of the burner cut away.

We will describe various embodiments of the invention with reference to the accompanying figures. FIG. 3A shows a cut-away perspective view of a burner nozzle 2 that can be used in a burner unit such as disclosed in European Patent Application EP 0969249A2, herein incorporated by reference. The burner nozzle 2 is made of a refractory material such as a ceramic. The burner nozzle 2 has a top surface 4, side surfaces 6 and 8, a hot face 10, and a cold face 12. A center flow passage 14 and outboard flow passages 16 and 18 (see, FIG. 4) are located within the burner nozzle 2. The flow passages 14, 16, and 18 terminate at orifices 20, 22, and 24, respectively, in the hot face 10. In one embodiment, the burner nozzle 2 has an internal plenum 26. (It should be clear, however, that the present invention is not limited to burner nozzles with internal plenums.) The plenum 26 is smoothly or fluidly connected to the internal flow passages 14, 16, and 18. In operation, a gaseous fuel or oxidant enters the plenum 26 from the rear direction, near the cold face 12, and is transferred to the flow passages 14, 16, and 18, where it exits through the orifices 20, 22, 24.

As discussed before, stresses tend to arise because of the temperature difference between the cooler internal flow passages and plenum, in those embodiments that have a plenum, and the outer hot face that is exposed to the interior of a high-temperature furnace. These large differences in temperature induce thermal stresses in the burner nozzle 2. While this situation makes the hot face 10 of the burner nozzle 2 particularly vulnerable to fracture, maximum tensile stresses occur in the interior of the flow passages, not just at the hot face. Discontinuities in the hot face 10 created by the orifices 20, 22, 24 and the internal flow passages 14, 16, 18 tend to concentrate stresses in the roofs (38, 54, 56 in FIG. 3B) and floors (39, 55, 57 in FIG. 3B) of each of the internal flow passages 14, 16, 18, and in those embodiments having a plenum, at the junction 36 between the internal flow passages 14, 16, 18 and the plenum 26, as well as the roof and floor of the plenum itself. Depending on whether a plenum is present, stresses tend to concentrate, relative to the hot face, in regions located at a distance of approximately 25% of the length of the burner nozzle.

Figure 3B:
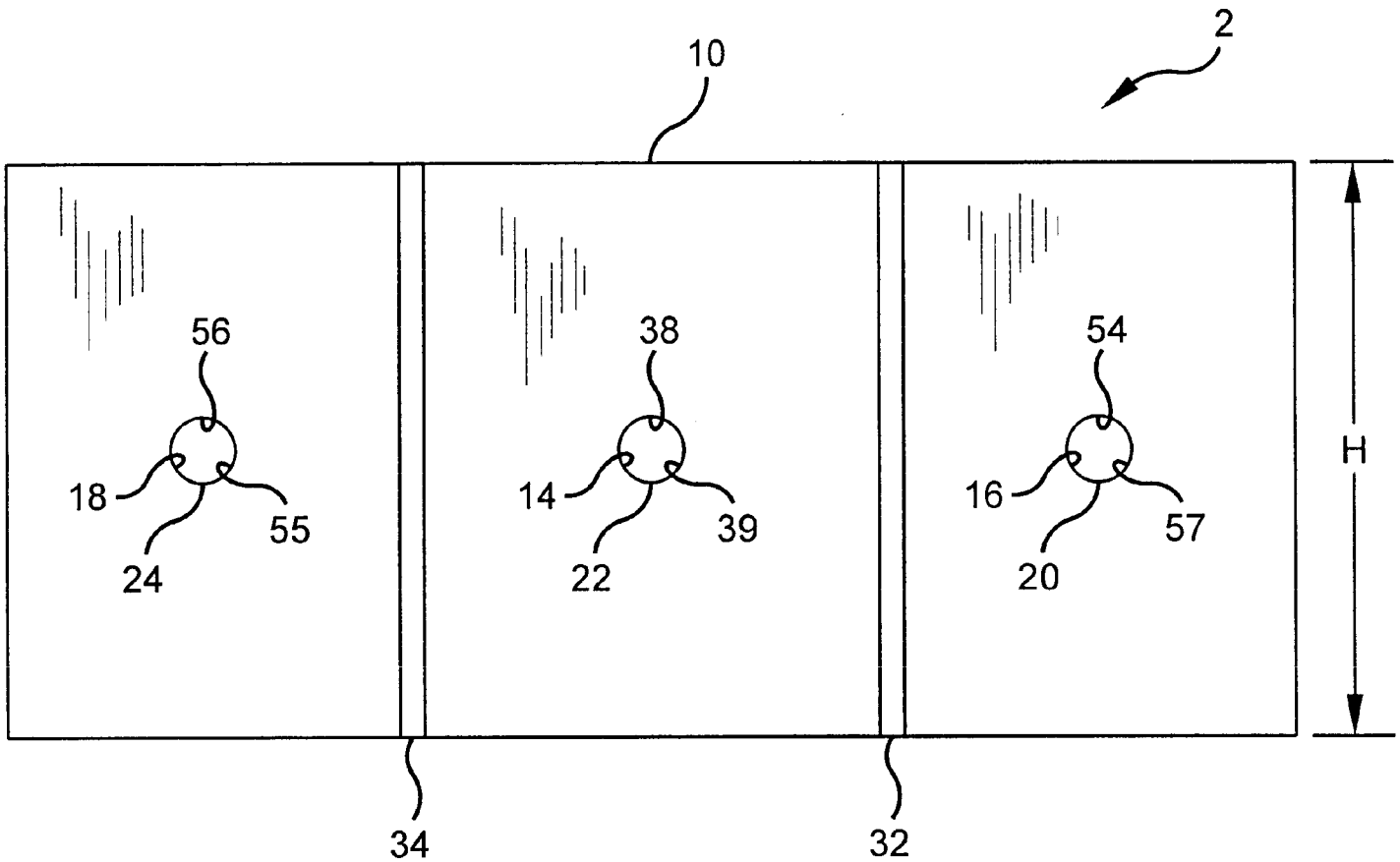
FIG. 3B shows the hot face of the burner nozzle of FIG. 3A.

Hence, to prevent the burner nozzle 2 from fracturing, as part of our invention, slits 32, 34 are provided in the hot face 10 to relieve stress in the burner nozzle 2. Preferably, a stress-relieving slit 32 is positioned midway between the orifices 20 and 22 and midway between the flow passages 14, 16, and another slit 34 is positioned midway between the orifices 20 and 24 and midway between the flow passages 14, 18. Stress-relieving slits 28 and 30 are also provided on the side surfaces 6, 8 of the burner nozzle 2, respectively, closer toward the hot face 10 of the burner nozzle 2. The internal flow passages 14, 16, 18, each have a longitudinal axis. The axes of two adjacent internal flow passages form an angle relative to each other, as the flow passages terminate at the hot face. The slit 32 formed in the hot face bisects the angle formed by the axes of flow passages 14 and 16, and slit 34 bisects the angle formed by the axes of flow passages 16, and 18. As shown in FIGS. 3A and 3B, the external height of the slits 32, 34 formed in the hot face are oriented to be parallel, or vertically situated with respect to the shortest dimension, or the height (H) of the burner nozzle.

Figure 4:
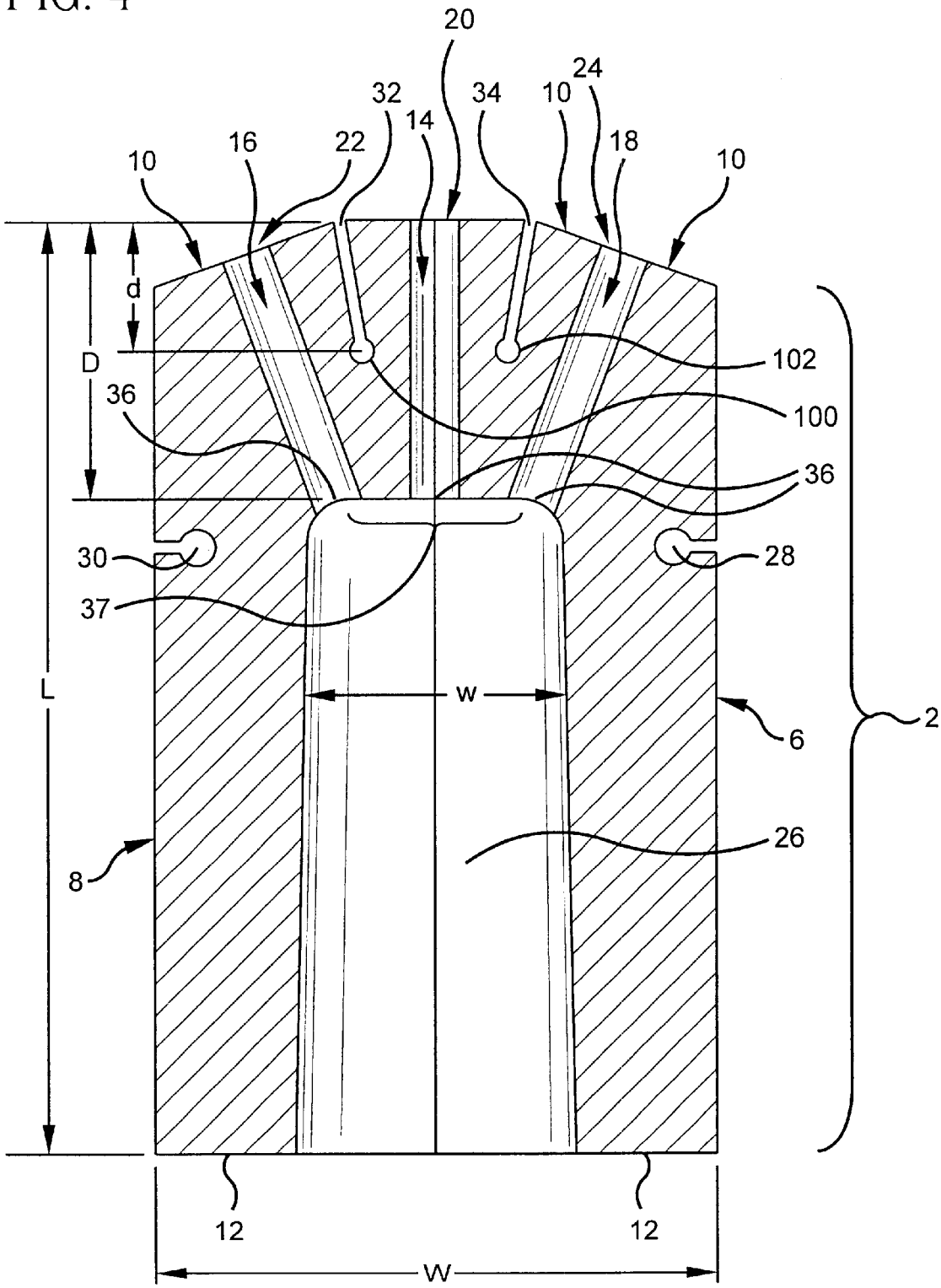
FIG. 4 shows a planar view of the internal structure of the burner nozzle of FIG. 3A.

In the discussions that follow, it would be helpful to refer to FIG. 4. The hot face 10 is used as a reference point for precisely describing the stress slits 28, 30, 32, and 34 on the burner nozzle 2. Referring to FIG. 4, the length "L" of the burner nozzle 2 is defined as the perpendicular distance from the hot face 10 to the back surface 12. The position of the stress slits 28 and 30 on the side surfaces 6, 8 is a fraction of the length "L" as measured from the hot face 10. Typically, the position of the stress slits 28 and 30 will be between approximately 0.3 L and 0.5 L. In our experiments, we set the location of stress slits 28 and 30 at approximately 0.35 L. The width "w" of the plenum 26 relative to the width "W" of the burner nozzle 2 limits the depth of the stress slits 28 and 30. The side surfaces 6, 8 have a predetermined thickness $$\left(\frac{W-w}{2}\right),$$

and the stress slits 28 and 30, have a depth of 20% to 50% of the thickness. As studied, the depth was approximately 33⅓% of the thickness.

Figure 5:
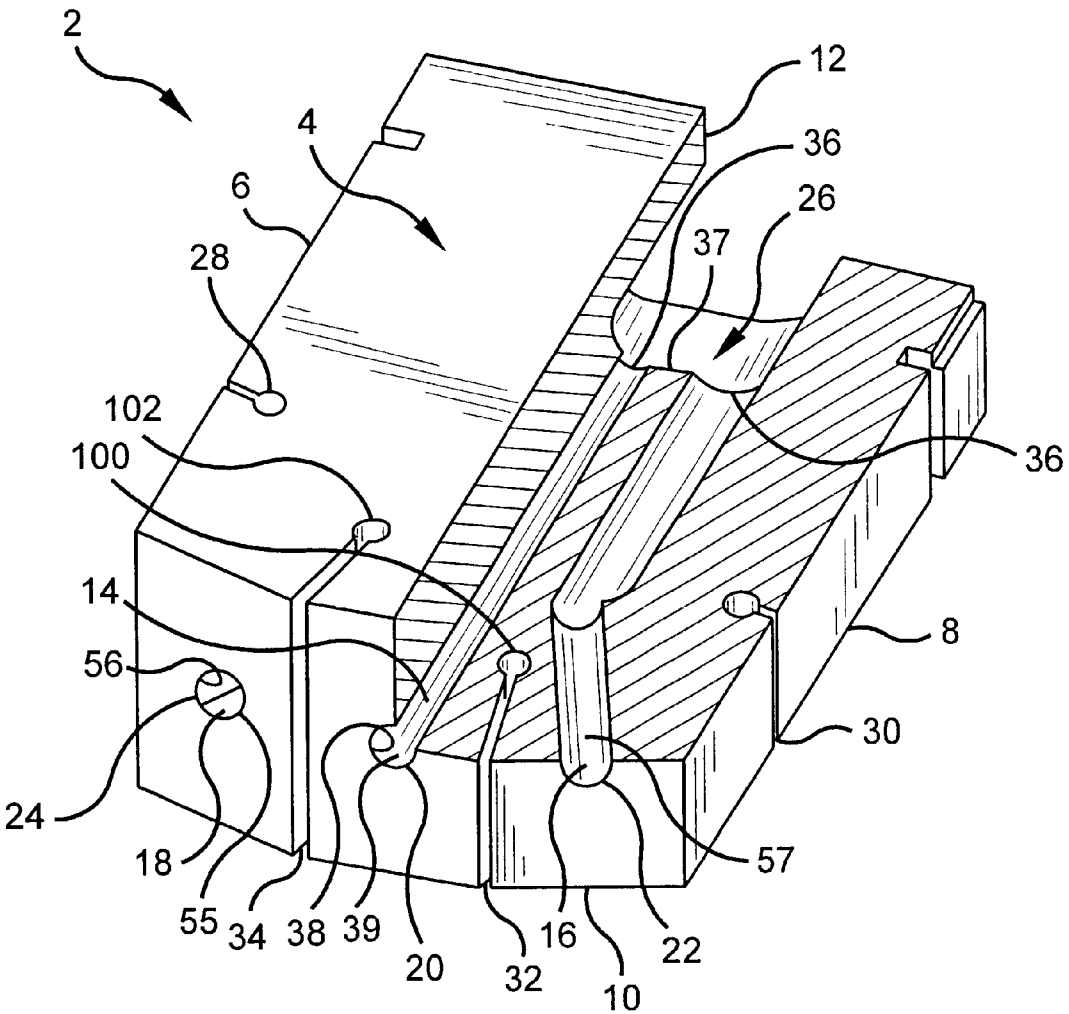
FIG. 5 shows a perspective view of a burner nozzle according to one embodiment of the invention having a short plenum, and with one quarter of the burner cut away.
Figure 6:
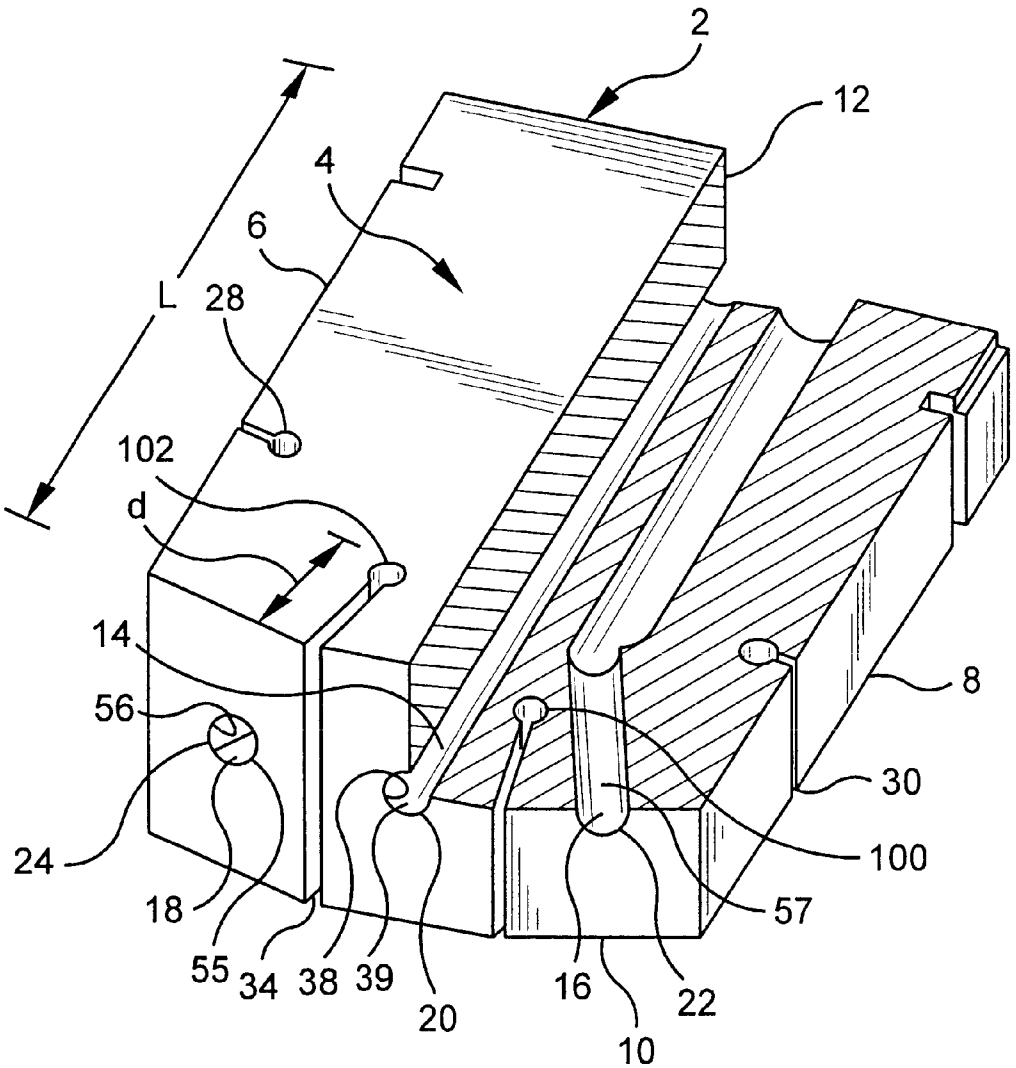
FIG. 6 shows a perspective view of a burner nozzle according to one embodiment of the invention having no plenum, and with one quarter of the burner cut away.

In FIG. 4, the stress-relief slits 32 and 34 have a depth "d" that is the perpendicular distance from the hot face 10 to the center of generally cylindrical portions 100, 102, respectively, of slits 32 and 34. Depth "d" is approximately 50% to 75% of a face depth "D." The face depth "D" is the perpendicular distance from the hot face 10 to the leading edge 37 or the plenum 26. In other words, the stress-relief slits formed in the hot face have a depth of approximately 10% to 75% of a length of a radius that bisects an angle made by at least a portion of the longitudinal axes of two adjacent internal flow passages relative to each other, as the flow passages terminate at the hot face. This alternative characterization can better describe embodiments of the burner nozzle that had a short plenum, as in FIG. 5, or no plenum, as in FIG. 6. When the burner has no plenum the flow passages 14, 16, 18, extend to the back surface 12 of the burn nozzle 2, wherein the face depth "D" approaches length "L" of the burner nozzle.

FIG. 7 is a graph that illustrates the effect of stress slits 28, 30, 32, and 34 on reducing stress in the roof 38 or floor of the center flow passage 14. In this illustration, "d" is the depth of the hot face stress slits 32, 34 and "D" is the depth of the hot face 10. The x-axis of the graph expresses the depth of the hot face stress slits 32 and 34 in a ratio of "d/D," and the y-axis expresses the percentage of stress reduced—relative to a maximum stress level in a center flow passage roof or floor that does not have slits of any kind—as a function of the depth of the hot face stress slits. The position of the side stress slits 28 and 30 with respect to the hot face 10 is maintained constant at roughly 0.35 L, where "L" is the length of the burner nozzle 2. Three sets of data points are given in the graph. First, a line 40 connects the data points corresponding to a scenario where the burner nozzle 2 has only side stress slits 28, 30, i.e., the hot face stress slits 32, 34 are absent from the burner nozzle 2. Second, a line 42 connects the data points corresponding to a scenario where the burner nozzle 2 has only hot face stress slits 32, 34, i. e., the side stress slits 28, 30 are absent from the burner nozzle 2. Third, a line 44 connects the data points corresponding to a scenario where the burner nozzle 2 has both hot face stress slits 32, 34 and side stress slits 28, 30.

In burner-nozzle designs having only side stress slits 28, 30, line 40 indicates that stress is reduced in the roof 38 of the center flow passage 14 by approximately 5%. By way of comparison, burner nozzle designs having only front stress slits 32, 34 experience a reduction of stress in the roof 38 or floor of the center flow passage 14 that ranges from approximately 5% to 23% for d/D ranging from 0.17 to 0.6. In one example, at d/D=0.6, we were able to reduce stress in roof 38 or floor of the center flow passage by as much as 18% over a burner having only side stress slits 28, 30 (shown in FIG. 3A) with the same d/D ratio. In our experiments, burner nozzle designs that have a combination of both hot face stress slits 32, 34 and side stress slits 28, 30 experience a reduction of stress in the roof 38 or floor of the center flow passage 14 that ranges from approximately 12% to 28% for a d/D ranging from approximately 0.17 to 0.6. Again, at d/D=0.6, we gained an additional 5% in stress reduction over the stress reduction that was achieved when deploying only front stress slits 32, 34.

FIG. 8 is another graph which illustrates the effect of stress slits 28, 30, 32, and 34 on reducing stress in the roof 46 or floor of a burner designed with a plenum 26. For this example, like in the FIG. 7, the depth "d" of the hot face stress slits 32 and 34 is expressed as a ratio of the depth "D" of the hot face, while the position of the side stress slits 28 and 30 is maintained constant at roughly 0.35 L with respect to the hot face 10. Again, three sets of data points are shown in the graph. First, the data points that are connected by line 48, correspond to a scenario where the burner nozzle 2 has only side stress slits 28, 30. Second, the data points that are connected by line 50, correspond to a scenario where the burner nozzle 2 has only hot face stress slits 32, 34 (shown in FIG. 3A). Third, the data points that are connected by line 52, correspond to a scenario where the burner nozzle 2 has both hot face stress slits 32, 34 and side stress slits 28, 30.

FIG. 8 illustrates that the percentage of stress reduced in the roof 38 or the floor of the center flow passage 14 at junction with the plenum 26 as a function of the depth of stress-relief slits in the hot face. In burner nozzle designs that have only side stress slits, line 48 indicates that stress reduction in the roof 46 of the plenum 26 dips below 10% as the depth of the stress-relief slit increases. That is, the amount of stress in the roof 46 or floor of the plenum 26 actually increases.

In contrast, burner-nozzle designs having only hot face stress slits 32, 34, stress reduction ranges from approximately 10% to 42% for a d/D ranging from 0.17 to 0.6. Again, "d" is the depth of the hot-face stress slits 32, 34 and "D" is the depth of the hot face 10. In general, for a given depth "D" of the hot face 10, the stress reduction in the roof 46 of the plenum 26 increases as the depth "d" of the stress slits 32, 34 increases. For burner-nozzle designs having a combination of hot-face stress slits 32, 34 and the side stress slits 28, 30, stress is reduced by a range of approximately 10% to 39% for a d/D ranging from 0.17 to 0.6.

FIG. 9 is another graph that illustrates the effect of stress slits 28, 30, 32, and 34 on reducing stress in the roofs 54, 56 or floors of the outboard flow passages 16, 18. Like in the two prior illustrations, "d" is the depth of the hot-face stress slits 32 and 34, as expressed as a ratio "d/D" of the depth "D" of the hot face 10. The position of the side stress slits 28 and 30 is again maintained constant at roughly 0.35 L with respect to the hot face 10. Three sets of data points are shown in the graph. The first set of data points, connected by the line 58, corresponds to a scenario where the burner nozzle 2 has only side stress slits 28, 30. The second set of data points, connected by the line 60, corresponds to a scenario where the burner nozzle 2 has only hot-face stress slits 32, 34. The third set of data points, connected by the line 62, corresponds to a scenario where the burner nozzle 2 has both hot-face stress slits 32, 34 and side stress slits 28, 30.

FIG. 9 indicates that burners nozzles with only side stress slits 28 manage to reduce the amount of stress in the roofs 54, 56 or floors of the outboard flow passages 16, 18 by a range of from 10% to 27%. On average, the stress reduction is approximately 22%. Burner nozzles that possessed only hot-face stress slits 32, 34 experienced a stress reduction of approximately 10% to 37% for a d/D ranging from 0.17 to 0.6. We observed that the deeper we made the hot-face stress slits, the greater the percentage of stress reduction, as is reflected in the graph. With a combination of both hot-face stress slits 32, 34 and side stress slits 28, 30, stress levels in the roofs or floors of the outboard flow passages reduced by as much as 32%, from approximately 10% to 42%, for a d/D ranging from 0.17 to 0.6.

As can be seen from FIG. 8, the incorporation of hot-face stress slits 32, 34 alone, into the design of a burner nozzle is sufficient to achieve significant stress reduction. In fact, we observed a surprising result. Just having hot face stress slits is more effective in reducing stresses in the roof 46 of the plenum 26 than either having a combination of hot face stress slits 32, 34 and side stress slits 28, 30 or side stress slits 28, 30 alone.

While, stresses in the roof 38 of the center flow passage 14 tend to contribute to longitudinal fracturing, stresses in the roofs 54, 56 or floors 55, 57 of the outboard flow passages 16, 18 tend to contribute to the development of diagonal fractures. Data plotted in FIGS. 7 and 9, demonstrate that a combination of both hot-face stress slits 32, 34 and side stress slits 28, 30 together is more effective in reducing stress in both the roof or floor 38, 39 of the center flow passage 14, and in the roofs 54, 56 or floors 55, 57 of the outboard flow passages 16, 18, respectively, than using either element independent of the other.

Figure 1:
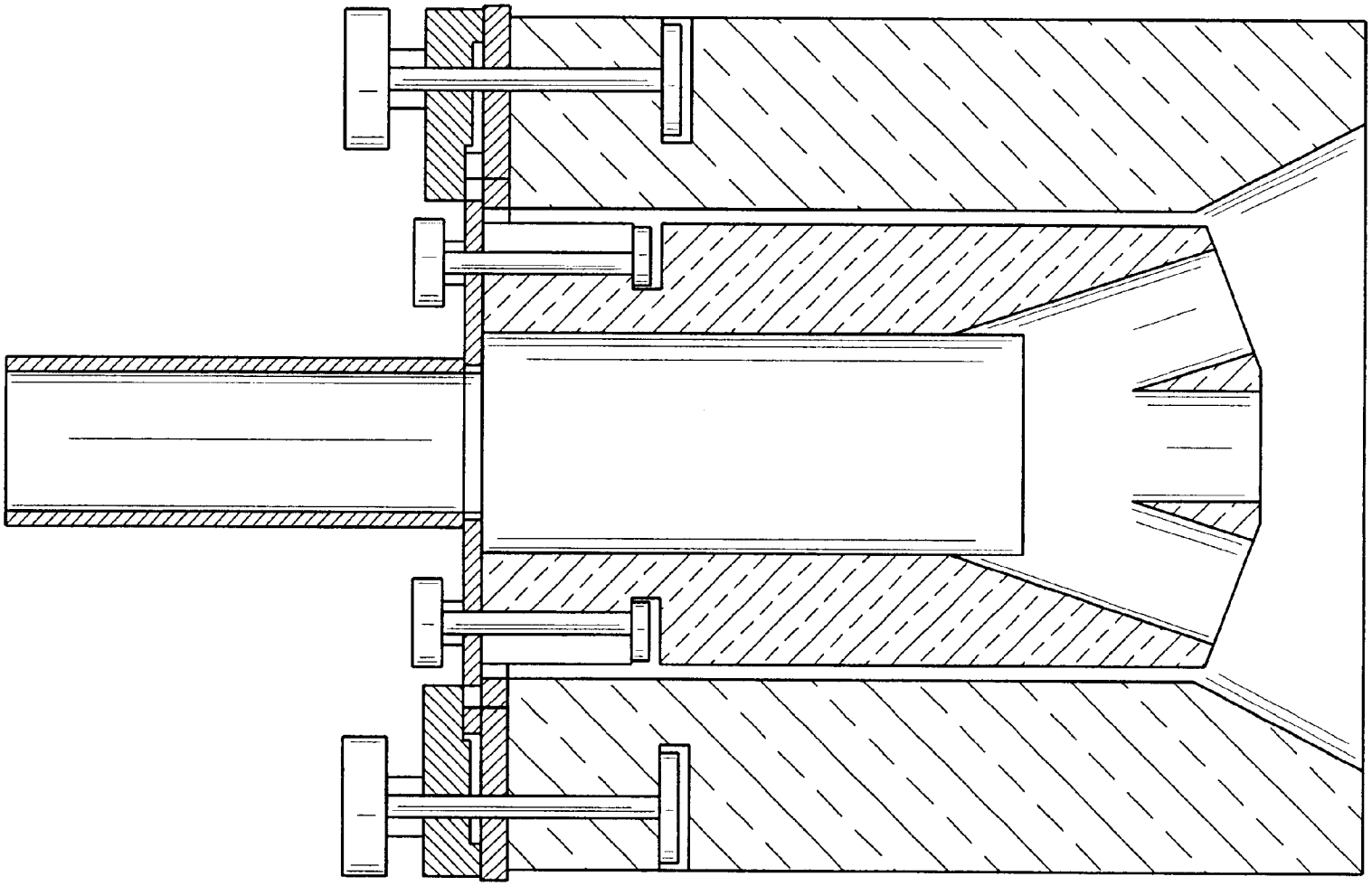
FIG. 1 PRIOR ART
FIG. 1 shows a prior-art burner nozzle design, which produces a wide flame.
Figure 2C:
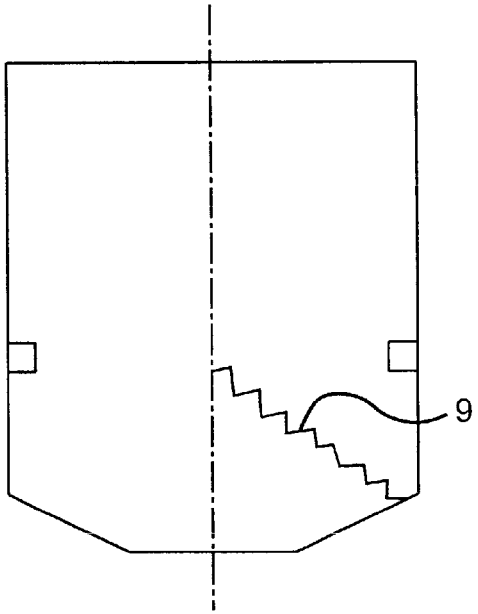
FIGS. 2A–2C show different types of fractures that can occur in burner nozzles.
Figure 2B:
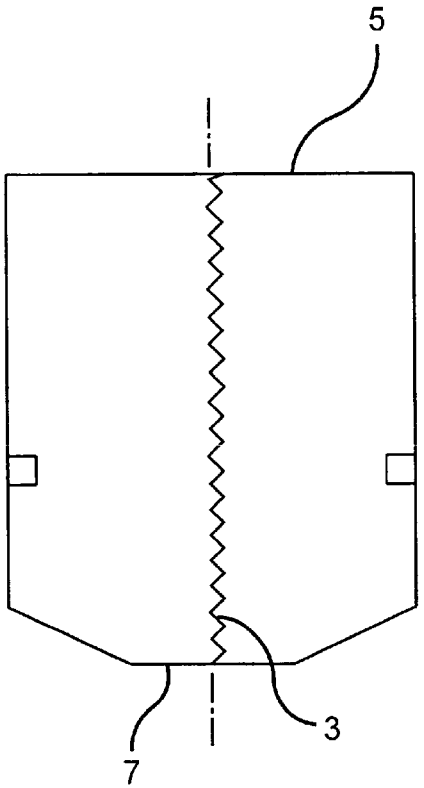
Figure 2A:
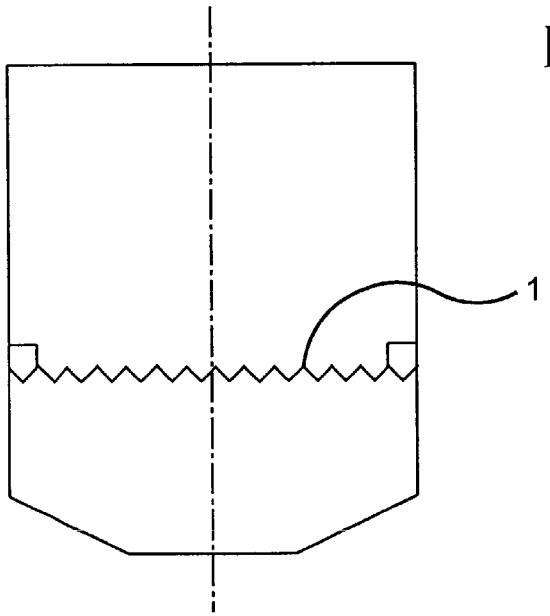

In general, hot-face stress slits 32, 34 are more effective in reducing stress in the roof 38 of the center flow passage 14 and the roof 46 of the plenum, while side stress slits 28, 30 tend to be more effective in reducing stress in the roofs 54, 56 of the outboard flow passages 16, 18. Overall, a combination of hot-face stress slits 32, 34 and side stress slits 28, 30 can result in significant reduction in the stress on the burner nozzle 2, especially in the areas that are most prone to fracture (see FIGS. 2A–2C). Preferably, the depth of the front stress slits 32, 34 range from 50% to 70% of the depth of the hot face 10.

To summarize, from the data provided in FIGS. 7, 8, and 9, we made certain observations of the present invention. With the combination of both hot face slits 32, 34, and side slits 28, 30 and d/D ratio ranging from 0.17 to 0.6 the maximum stress: (i) in the roof 38 or floor of the center flow passage 14 can be reduced by about 12% to 28%; (ii) in the roof 46 or floor of a burner with a plenum 26 can be reduced by about 10% to 39%; (iii) in the roofs 54, 56 or floors of outboard flow passages 16, 18 can be reduced by 32%. These are significant amounts of stress reduction, which as discussed below, can prevent burner nozzle failures and extend the useful nozzle life by orders of magnitude.

Figure 10A:
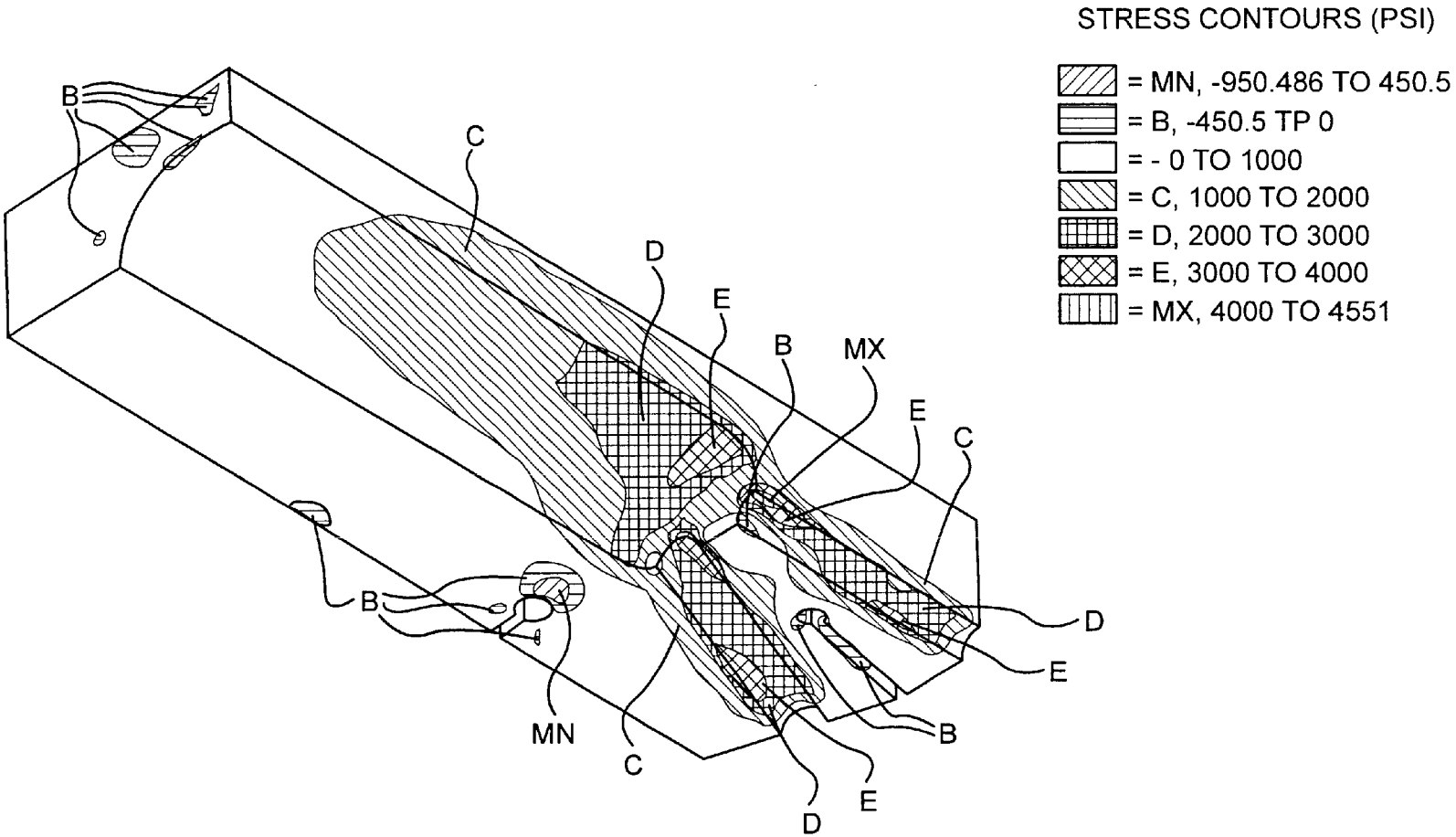
FIG. 10A is a perspective view of a quarter of the burner nozzle shown in FIG. 3A, showing a contour illustration of the stress concentrations in the roof or floor of the center flow passage and an outboard flow passage.

As previously mentioned, most structural failures in burner nozzles are due to transverse fractures caused by stress in the roof or floors of the plenum. FIGS. 10A and 10B show a quarter view of a roof or floor of the burner nozzle shown in FIG. 3A, and illustrate the reduction of stresses using contour lines. Although prior burner configurations may result in some decrease in stress of about ten percent, this quantity and quality of stress reduction is neither widespread nor even across areas of stress concentration in the burner nozzle. According to the present invention, the level of stress is reduced considerably in all three critical places where fractures usually have been observed.

To quantify the practical effect of stress reduction, the life of a burner nozzle 2 as a function of stress reduction can be obtained from equation (1) below:

$$t = t_0\left(\frac{\sigma_0}{\sigma}\right)^n \tag{1}$$

where $\sigma_0$ is the stress in a burner nozzle without stress slits, $\sigma$ is stress in a burner nozzle with stress slits, $t_o$ is the nozzle life for stress $\sigma_0$, t is the nozzle life for stress $\sigma$, and n is the fatigue constant for the nozzle material. Equation (1) is further discussed in detail in papers[2] by A. G. Evans and S. T. Gulati, respectively, which are both herein incorporated in their entirety by reference.

Table 1, below, shows the effect of stress reduction on nozzle life, for an example assuming that n=25.

TABLE 1

Increase in Nozzle Life as a Function of Stress Reduction

| Stress Reduction (%) | $\sigma/\sigma_0$ = [1 − (Stress reduction)/100] | Increase in Nozzle Lifetime |
|---|---|---|
| 10 | 0.90 | $13.93t_0$ |
| 15 | 0.85 | $58.15t_0$ |
| 20 | 0.80 | $264.70t_0$ |
| 25 | 0.75 | $1328.83t_0$ |
| 30 | 0.70 | $7456.74t_0$ |
| 35 | 0.65 | $47551.70t_0$ |
| 40 | 0.60 | $351737.56t_0$ |
| 45 | 0.55 | $3096949.80t_0$ |

As shown in Table 1, the present invention greatly enhances the useful life of a burner nozzle. By using a combination of both hot-face stress slits and side stress slits, the overall thermal stress levels throughout the burner nozzle are significantly reduced, especially the high stress regions. This stress reduction can prolong the lifetime of the burner nozzle by at least one order, but more probably several orders of magnitude. A longer useful life for a burner nozzle has many commercial advantages for high-temperature furnace operation. Furnace operators need not replace nozzles as often as currently required, or possibly need to rebuild a furnace as frequently. Both of these effects can contribute significantly to cost savings.

Although the present invention has been described by way of a limited number of embodiments, it will be apparent to those skilled in the art that various modifications and variations can be made to the present glass compositions without departing from the spirit and scope of the invention. Therefore, unless such changes and modifications otherwise depart from the scope of the present invention, they should be construed as included herein.

We claim:

1. A burner nozzle comprising a hot face, side surfaces, a plurality of internal flow passages that terminate at the hot face, and a number of stress-relieving mechanisms in the hot face, wherein the internal flow passages each have a longitudinal axis, and at least a portion of said axes of two adjacent internal flow passages form an angle relative to each other as the internal flow passages terminate at the hot face, and the stress-relieving mechanisms in the hot face have a depth of about 10% to 75% of a length of a radius bisecting said angle.

2. The burner nozzle according to claim 1, wherein the burner nozzle further includes an internal plenum fluidly connected to the internal flow passages.

3. The burner nozzle according to claim 1, wherein the stress-relieving mechanisms in the hot face have a depth of about 50% to 75% of a perpendicular distance from the hot face to a leading edge of the plenum.

4. The burner nozzle according to claim 1, wherein a number of stress-relieving mechanisms are in the side surfaces.

5. The burner nozzle according to claim 1, wherein the stress-relieving mechanisms in said side surfaces are positioned at about 30% to 50% of a length of the burner nozzle, relative to the hot face.

6. The burner nozzle according to claim 1, wherein the side surfaces have a predetermined thickness, and the stress-relieving mechanisms in the side surfaces have a depth of about 20% to 50% of the thickness.

7. The burner nozzle according to claim 1, wherein said stress-relieving mechanisms terminate in a generally cylindrical portion.

8. The burner nozzle according to claim 1, wherein said stress-relieving mechanisms are oriented in different directions.

9. A burner nozzle comprising: a hot face, first and second side surfaces, a plurality of internal flow passages that terminate in the hot face, at least one stress-relief slit in the hot face, positioned between adjacent internal flow passages, and at least one stress-relief slit in each side surface, wherein the stress-relief slit in each side surface is positioned, relative to the hot face, approximately 30% to 50% of a length of the burner nozzle.

10. The burner nozzle according to claim 9, wherein said stress-relief slits in the hot face has a depth that ranges from about 25% to 75% of a depth of the hot face.

11. The burner nozzle according to claim 9, wherein the burner further comprises an internal plenum fluidly connected to the internal flow passages.

12. The burner nozzle according to claim 9, wherein said stress-relief slit in the hot face is positioned midway between adjacent internal flow passages.

13. The burner nozzle according to claim 9, wherein the internal flow passages each have a longitudinal axis, and at least a portion of the axes of two adjacent internal flow passages form an angle relative to each other.

14. The burner nozzle according to claim 9, wherein said stress-relief slit in the hot face substantially bisects said angle.

15. The burner nozzle according to claim 9, wherein said stress-relief slits terminate in a generally cylindrical portion.

16. The burner nozzle according to claim 9, wherein said stress-relief slits are oriented in different directions.

17. A method for reducing thermally generated stresses in a refractory burner nozzle, the method comprising: providing a burner nozzle having a hot face, side surfaces, and a plurality of internal flow passages; forming a number of stress-relieving mechanisms in said hot face, wherein when the internal flow passages each have a longitudinal axis, and at least part of the axes of two adjacent internal flow passages form an angle relative to each other, said stress-relieving mechanisms in the hot face have depth of about 10% to 75% of a length of a radius bisecting said angle.

18. The method according to claim 17, wherein said stress-relieving mechanism in the hot face is positioned between adjacent internal flow passages that terminate in the hot face.

19. The method according to claim 17, wherein said stress-relieving mechanism in the hot face is positioned midway between said adjacent internal flow passages.

20. The method according to claim 17, wherein said burner nozzle further includes an internal plenum fluidly connected to said internal flow passages.

21. The method according to claim 17, wherein the stress-relieving mechanisms in the hot face have a depth of about 50% to 75% of a perpendicular distance from said hot face to a leading edge of said plenum.

22. The method according to claim 17, further comprising forming a number of stress-relieving mechanisms in said side surfaces.

23. The method according to claim 17, wherein said stress-relieving mechanisms in the side surfaces are positioned, relative to the hot face, at about 30% to 50% of a length of said burner nozzle.

24. The method according to claim 17, wherein said side surfaces have a predetermined thickness, and said stress-relieving mechanisms in the side surfaces have a depth of about 20% to 50% of the thickness.

25. The method according to claim 17, wherein said stress-relieving mechanisms in the hot face are a number of slits.

26. The method according to claim 17, wherein said stress-relieving mechanisms terminate in a generally cylindrical portion.

27. A method for extending the useful life of a refractory burner nozzle, the method comprising: providing a burner nozzle having a hot face, a first and second side surfaces, and a plurality of internal flow passages; forming a number of stress-relieving mechanisms in said hot face, wherein said stress-mechanisms in the hot face has a depth that ranges from about 25% to 75% of a depth of the hot face.

28. The method according to claim 27, wherein said stress-relieving mechanism in the hot face is positioned between adjacent internal flow passages that terminate in the hot face.

29. The method according to claim 27, wherein said stress-relieving mechanism in the hot face is positioned midway between said adjacent internal flow passages.

30. The method according to claim 27, wherein said burner nozzle further includes an internal plenum fluidly connected to the internal flow passages.

31. The method according to claim 27, wherein said stress-relieving mechanisms in the hot face have a depth of about 50% to 75% of a perpendicular distance from the hot face to a leading edge of the plenum.

32. The method according to claim 27, wherein when said internal flow passages each have a longitudinal axis, and at least a portion of said axes of two adjacent internal flow passages form an angle relative to each other, said stress-relieving mechanisms in the hot face have a depth of about 10% to 75% of a length of a radius bisecting said angle.

33. The method according to claim 27, further comprising forming a number of stress-relieving mechanisms in each of said side surfaces.

34. The method according to claim 27, wherein the stress-relieving mechanisms in said side surfaces are positioned at about 30% to 50% of a length of the burner nozzle, relative to said hot face.

35. The method according to claim 27, wherein said side surfaces have a predetermined thickness, and the stress-relieving mechanisms in the side surfaces have a depth of about 20% to 50% of the thickness.

* * * * *